US008122674B2

(12) United States Patent
Bartley et al.

(10) Patent No.: US 8,122,674 B2
(45) Date of Patent: Feb. 28, 2012

(54) GRATING SYSTEM FORVEHICULAR AND PEDESTRIAN TRAFFIC

(75) Inventors: John C. Bartley, Canton, OH (US); Kenneth P. Apperson, Canton, OH (US)

(73) Assignee: Ohio Gratings, Inc., Canton, OH (US)

( * ) Notice: Subject to any disclaimer, the term of this patent is extended or adjusted under 35 U.S.C. 154(b) by 231 days.

(21) Appl. No.: 12/438,000

(22) Filed: May 8, 2009

(65) Prior Publication Data

US 2010/0281813 A1 Nov. 11, 2010

(51) Int. Cl.
*E03F 5/06* (2006.01)

(52) U.S. Cl. ..... 52/664; 52/668; 52/660; 52/177; 404/2; 210/164

(58) Field of Classification Search ..... 52/664, 52/653.1, 668, 669, 660, 177, 20; 404/2, 404/70; 210/163, 164
See application file for complete search history.

(56) References Cited

U.S. PATENT DOCUMENTS

| | | | | |
|---|---|---|---|---|
| 1,214,928 | A | 2/1917 | Lachman | |
| 2,114,773 | A | 4/1938 | Auten et al. | |
| 2,128,753 | A | 8/1938 | Lienhard | |
| 2,190,214 | A | 2/1940 | Wagin | |
| 2,509,732 | A | 5/1950 | Ernestus | |
| 2,645,985 | A * | 7/1953 | Beebe et al. | 52/667 |
| 2,834,267 | A * | 5/1958 | Beebe | 52/667 |
| 2,952,905 | A * | 9/1960 | Lorig | 29/897.15 |
| 3,260,023 | A | 7/1966 | Nagin | |
| 3,881,832 | A | 5/1975 | Maguire | |
| 4,046,482 | A * | 9/1977 | Paasch | 404/4 |
| 4,409,770 | A * | 10/1983 | Kawaguchi et al. | 52/666 |
| 4,452,025 | A | 6/1984 | Lew | |
| 4,661,245 | A * | 4/1987 | Rutherford et al. | 209/399 |
| 4,761,930 | A * | 8/1988 | Tepera | 52/669 |
| 4,780,021 | A | 10/1988 | Bettigole | |
| 4,865,486 | A | 9/1989 | Bettigole | |
| 4,897,299 | A * | 1/1990 | Kawachi et al. | 428/131 |
| 5,454,128 | A | 10/1995 | Kwon | |
| 5,463,786 | A * | 11/1995 | Mangone et al. | 14/73 |
| 5,509,243 | A | 4/1996 | Bettigole | |
| 5,595,034 | A | 1/1997 | Krysalka et al. | |
| 5,733,445 | A | 3/1998 | Fanelli | |
| 5,864,910 | A * | 2/1999 | Mangone | 14/73 |
| 6,049,932 | A | 4/2000 | Mangone | |
| 6,706,172 | B2 | 3/2004 | Strawser, Sr. | |
| 6,908,549 | B2 | 6/2005 | Middleton et al. | |
| 7,121,759 | B2 | 10/2006 | Woodson et al. | |
| 7,393,153 | B2 * | 7/2008 | Woodson et al. | 404/2 |

* cited by examiner

*Primary Examiner* — Phi Dieu Tran A
(74) *Attorney, Agent, or Firm* — Sand & Sebolt

(57) ABSTRACT

A grating system typically includes longitudinal deep bars, axial crossbars, longitudinal filler bars seated on the crossbars between the deep bars and axial joining bars which join the deep bars and filler bars to one another. The crossbars are inserted lengthwise through slots formed in the deep bars. The joining bars are inserted lengthwise into holes formed in the deep bars and filler bars. The joining bars are typically above and aligned with the crossbars. The upper surfaces of the crossbars and filler bars are substantially flush with one another to form most of the upper surface of the grating system on which vehicular and pedestrian traffic typically travel.

21 Claims, 9 Drawing Sheets

GRATING SYSTEM FORVEHICULAR AND PEDESTRIAN TRAFFIC

BACKGROUND OF THE INVENTION

1. Technical Field

The present invention relates generally to grates and grating systems. More particularly, the invention relates to a grating assembly which may accommodate vehicle traffic and pedestrian traffic.

2. Background Information

There have been various improvements in grating assemblies which are configured for supporting vehicle traffic while also conveniently accommodating pedestrian traffic. For instance, these grating assemblies are configured with spacing along the upper surface which is appropriate for accommodating wheelchairs without the risk of the wheels thereof becoming stuck, and also for accommodating walking canes and the spikes of high heeled shoes without the canes or spikes becoming stuck and thus presenting an injury problem. U.S. Pat. No. 7,121,759 granted to Woodson et al. provides such a grating assembly. However, one of the drawbacks to the Woodson configuration is the use of welds on the upper surface of the grating assembly which detracts from its aesthetic appeal.

The prior art also includes gratings which are used particularly to form bridge decks. For instance, U.S. Pat. No. 6,049,932 granted to Mangone discloses weld-free grids or gratings for bridge decks where the grating is typically filled with concrete and thus serves as a reinforcing structure with the concrete extending above the upper surface of the grating. Although the Mangone reference may utilize minor welding, it is configured primarily to eliminate or substantially eliminate welds between its various bars. One key aspect of the Mangone reference is the use of notches in some of its bars in order to provide an interlocking configuration at the intersections of certain bars. For instance, Mangone discloses primary load-bearing members having rectangular through openings formed therein for receiving a secondary load-bearing member therethrough wherein the secondary member includes downwardly opening bottom notches or slots which are aligned with the portions of the primary members which bound the bottom of the through openings therethrough so that the bottom slots receive therein this portion of the load-bearing member. While Mangone indicates that this configuration locks the two members in position, this configuration is less than desirable for use with a grating assembly which is intended to be used on its own without concrete inasmuch as such a locking configuration without the use of concrete or welding would tend to become loose over time especially under regular traffic traveling over the grating assembly. The present invention addresses these and other problems in the art.

BRIEF SUMMARY OF THE INVENTION

The present invention provides a grating system having longitudinal and axial directions comprising: a plurality of axially spaced longitudinal deep bars each having top and bottom surfaces; a first set of aligned through slots formed in the deep bars; a second set of aligned through slots formed in the deep bars and longitudinally spaced from the first set of slots; a first set of aligned deep bar through holes formed in the deep bars upwardly of the first set of slots; a second set of aligned deep bar through holes formed in the deep bars upwardly of the second set of slots; a first axial crossbar slidably inserted lengthwise into the first set of slots; a second axial crossbar slidably inserted lengthwise into the second set of slots; a plurality of longitudinal filler bars seated on the crossbars between the deep bars and having respective top surfaces which are substantially flush with the top surfaces of the deep bars; a first set of aligned filler bar through holes formed in the filler bars and aligned with the first set of deep bar holes; a second set of aligned filler bar through holes formed in the filler bars and aligned with the second set of deep bar holes; a first axial joining bar slidably inserted lengthwise into the first set of deep bar holes and first set of filler bar holes; a second axial joining bar slidably inserted lengthwise into the second set of deep bar holes and second set of filler bar holes; and wherein each crossbar has joined and unjoined positions in which it is respectively separate from and joined to the deep bars; and each crossbar is slidably inserted lengthwise into the respective set of slots along a linear path to move from the unjoined position to the joined position such that the linear slidable insertion alone substantially fixes the position of the respective crossbar in the vertical and longitudinal directions relative to the deep bars.

The present invention also provides a grating system having longitudinal and axial directions comprising: a plurality of axially spaced longitudinal deep bars each having top and bottom surfaces; a first set of aligned through slots formed in the deep bars; a second set of aligned through slots formed in the deep bars and longitudinally spaced from the first set of slots; a first set of aligned deep bar through holes formed in the deep bars upwardly of the first set of slots; a second set of aligned deep bar through holes formed in the deep bars upwardly of the second set of slots; a first axial crossbar slidably inserted lengthwise into the first set of slots; a second axial crossbar slidably inserted lengthwise into the second set of slots; a plurality of longitudinal filler bars seated on the crossbars between the deep bars and having respective top surfaces which are substantially flush with the top surfaces of the deep bars; a first set of aligned filler bar through holes formed in the filler bars and aligned with the first set of deep bar holes; a second set of aligned filler bar through holes formed in the filler bars and aligned with the second set of deep bar holes; a first axial joining bar slidably inserted lengthwise into the first set of deep bar holes and first set of filler bar holes; a second axial joining bar slidably inserted lengthwise into the second set of deep bar holes and second set of filler bar holes; and wherein the crossbars have top and bottom surfaces; and the crossbars are free of bottom notches which extend upwardly from their respective bottom surfaces and receive therein respective portions of the deep bars to interlock the crossbars and deep bars to one another.

The present invention further provides a grating system having longitudinal and axial directions comprising; a plurality of axially spaced longitudinal deep bars each having top and bottom surfaces; a first set of aligned through slots formed in the deep bars; a second set of aligned through slots formed in the deep bars and longitudinally spaced from the first set of slots; a first set of aligned deep bar through holes formed in the deep bars upwardly of the first set of slots; a second set of aligned deep bar through holes formed in the deep bars upwardly of the second set of slots; a first axial crossbar slidably inserted lengthwise into the first set of slots; a second axial crossbar slidably inserted lengthwise into the second set of slots; a plurality of longitudinal filler bars seated on the crossbars between the deep bars and having respective top surfaces which are substantially flush with the top surfaces of the deep bars; a first set of aligned filler bar through holes formed in the filler bars and aligned with the first set of deep bar holes; a second set of aligned filler bar through holes formed in the filler bars and aligned with the second set of deep bar holes; a first axial joining bar slidably inserted lengthwise into the first set of deep bar holes and first set of filler bar holes; a second axial joining bar slidably inserted lengthwise into the second set of deep bar holes and second set of filler bar holes; wherein the deep bars and crossbars intersect one another at respective intersections; and a plurality of welds securing the deep bars and crossbars to one another at a majority of the intersections.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
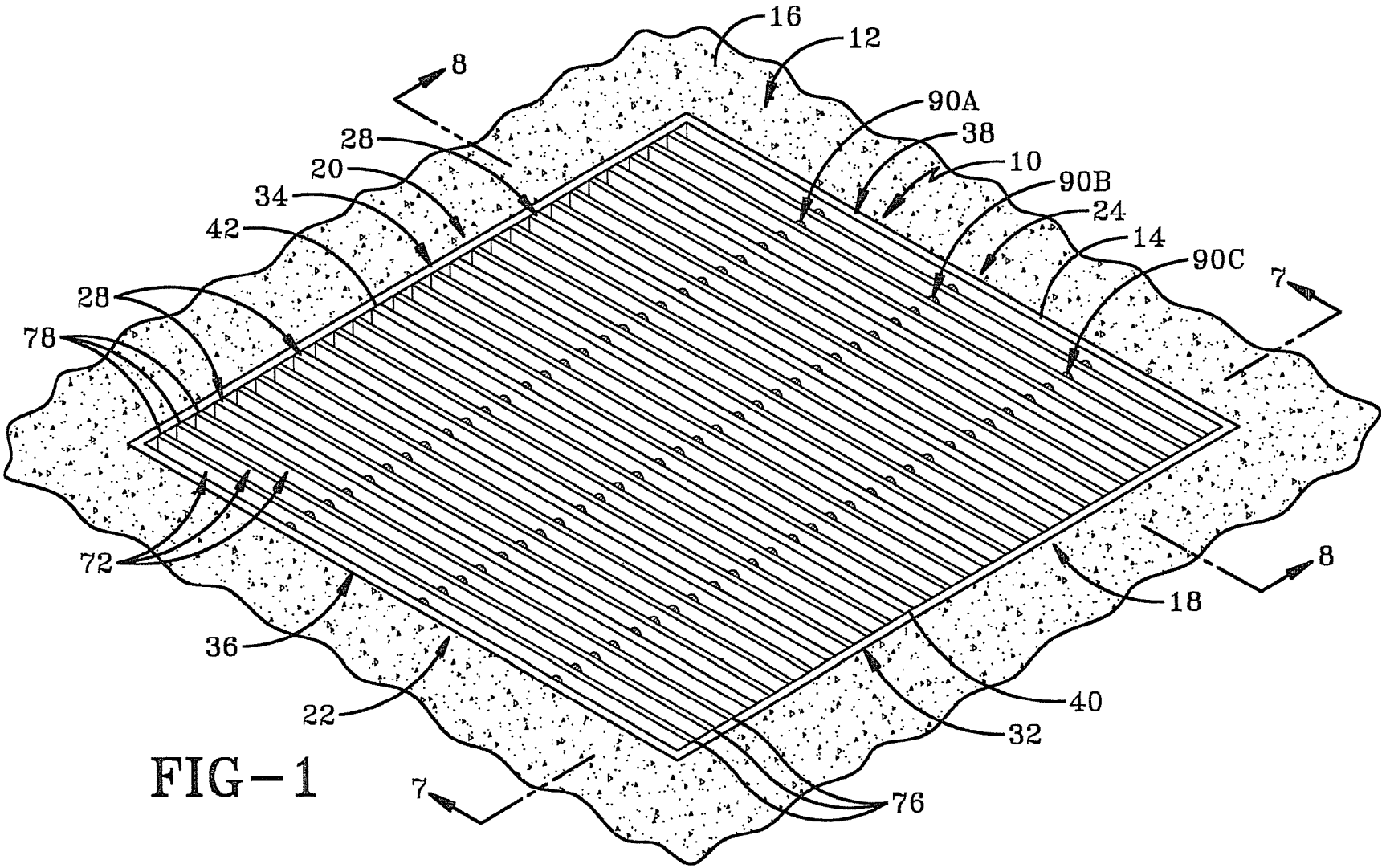
FIG. 1 is a perspective view of the grating system of the present invention as it would appear installed in the ground.
Figure 2:
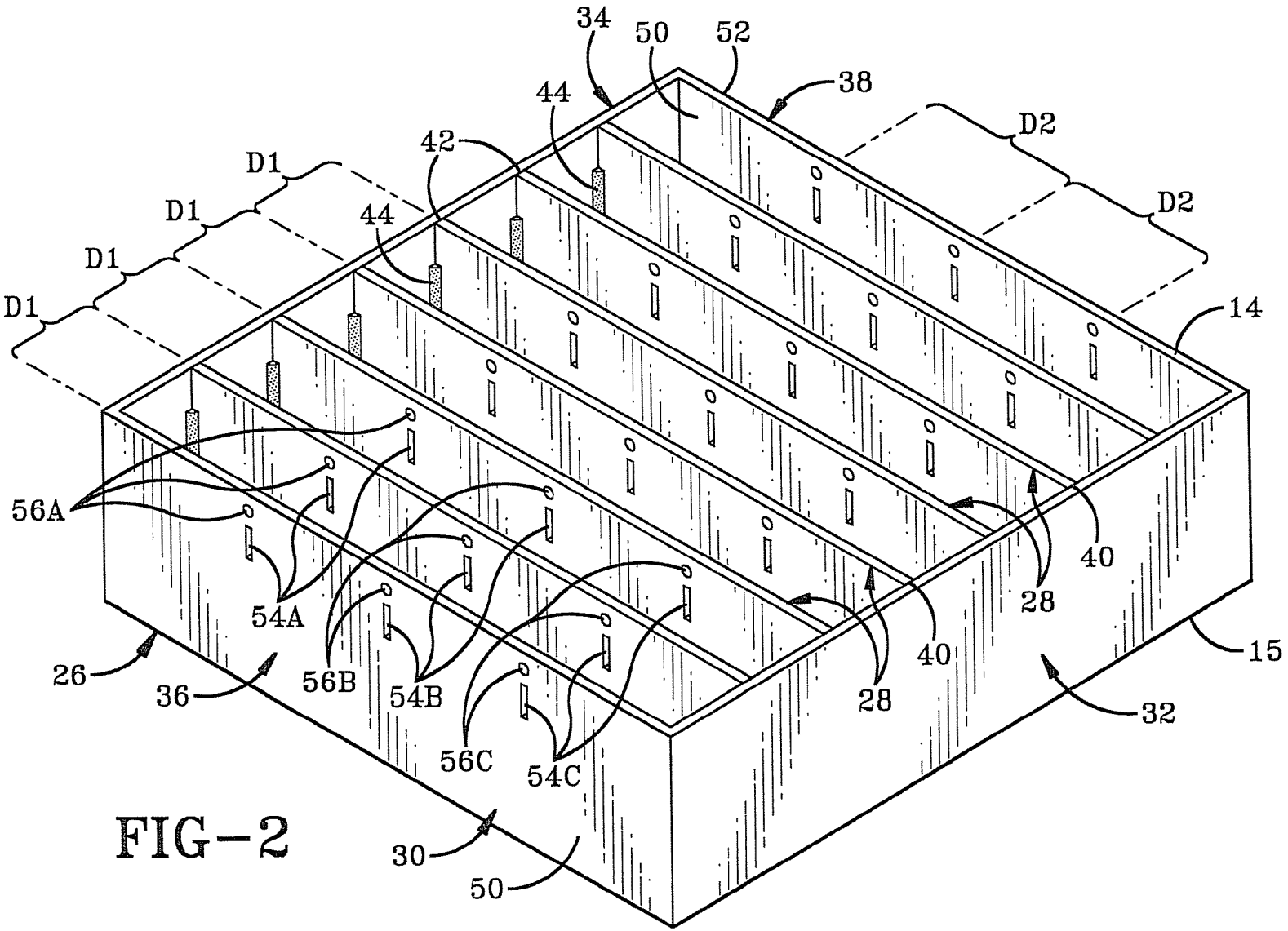
FIG. 2 is a perspective view of the base structural framework of the grating assembly which primarily is formed of multiple deep bars.

The grating system of the present invention is shown generally at 10 in FIG. 1 installed on a supporting structure 12 which may include a bed of concrete or the like in which grating system 10 is embedded. Grating assembly or system 10 is mostly typically formed of metal and has a top or upper surface 14 which is substantially flush with or at the same height of an upper surface 16 of supporting structure 12. System 10 also has a bottom or lower surface 15 (FIG. 2). System 10 has first and second ends 18 and 20 defining therebetween a longitudinal direction of the system, and first and second opposed sides 22 and 24 defining therebetween an axial direction of the system. Although system 10 is shown FIG. 1 as imbedded in the ground, it may also be used to form an overhead walkway or bridge whereby the openings defined between its various components allow a person to see objects therebelow as they walk or ride across the bridge in a vehicle. Upper surface 14 of system 10 is thus intended to be a contact surface which is contacted by a pedestrian or the wheels of a wheelchair or other vehicle during travel over the grating assembly. System 10 is thus configured as a see-through grating assembly which stands on its own as opposed to being used as a reinforcement structure for concrete or the like. System 10 is thus ordinarily free of concrete disposed within the spaces defined between its various bars, which are described in greater detail below.

Figure 3:
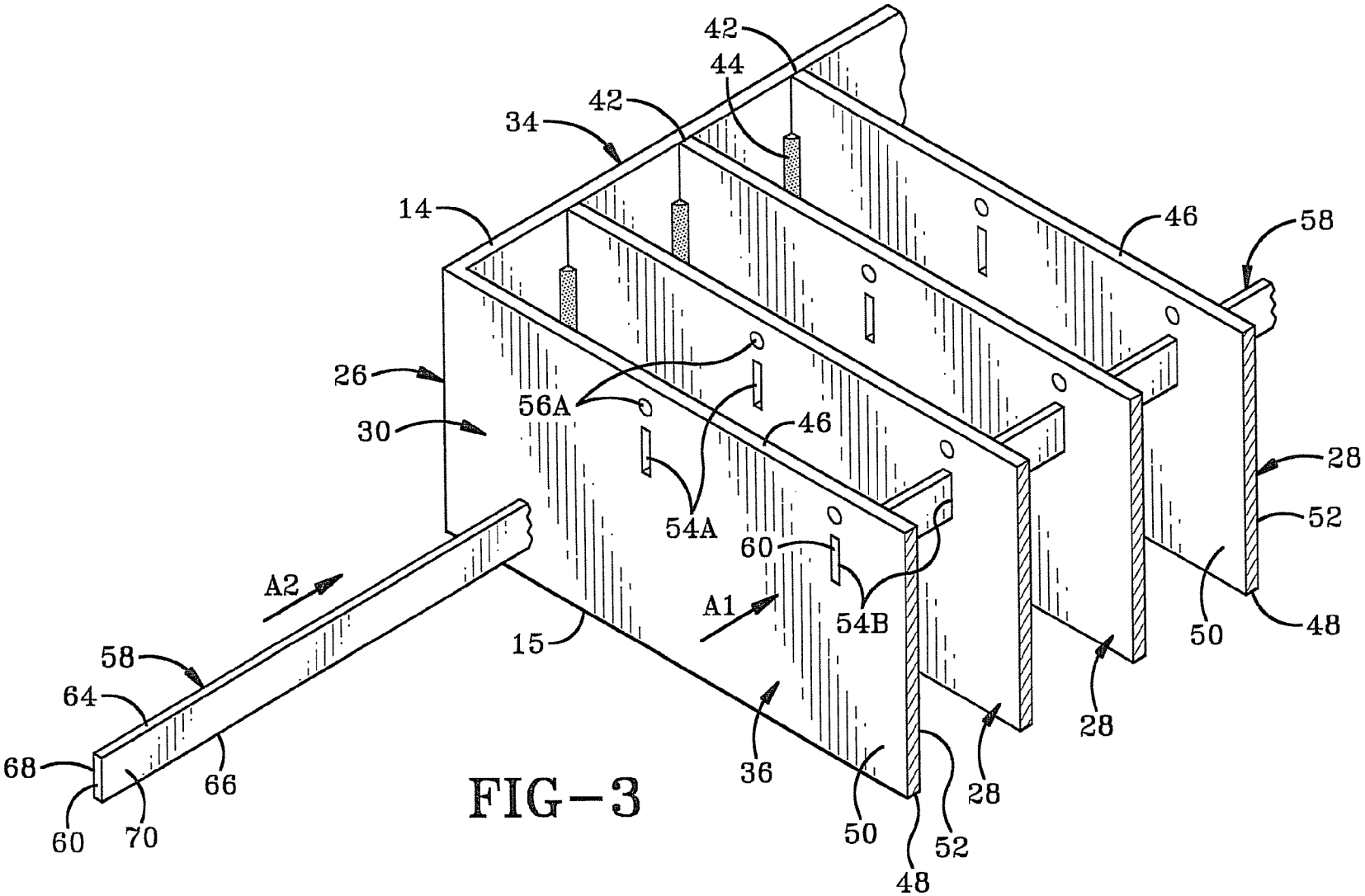
FIG. 3 is an enlarged perspective view of a portion of FIG. 2 illustrating the insertion of the crossbars through the slots in the deep bars.
Figure 9:
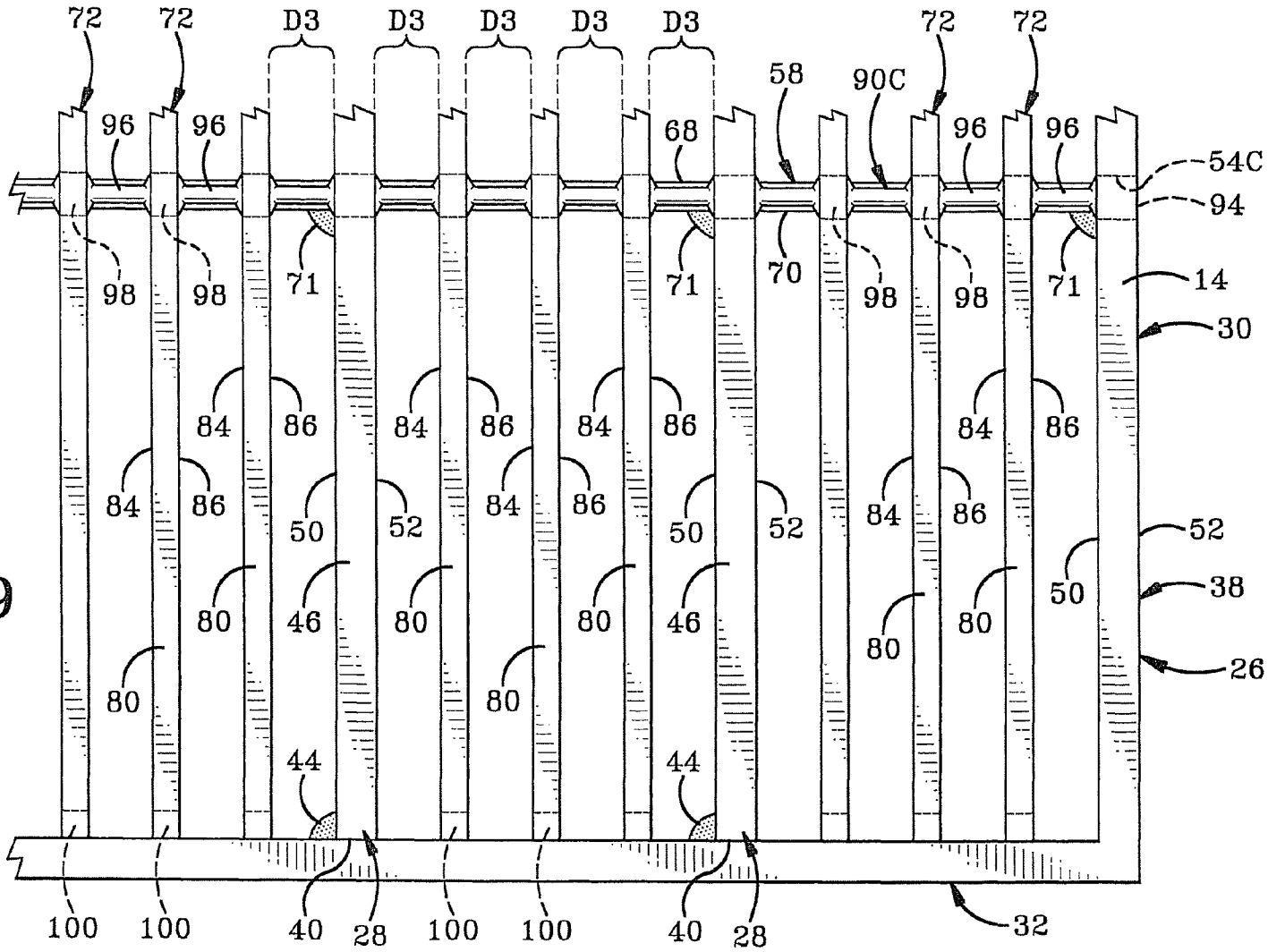
FIG. 9 is a top plan view of a portion of the grating assembly adjacent one of its corners.

With reference to FIG. 2, system 10 includes a rigid primary framework or grating subassembly 26 primarily comprising a plurality of straight longitudinal deep bars 28 which are typically axially evenly spaced from one another and rigidly mounted within a perimeter wall 30 which includes first and second opposed typically parallel axial end bars 32 and 34, and first and second typically parallel longitudinal side bars 36 and 38 which extend perpendicularly between and are rigidly connected to end bars 32 and 34 to form respective corners in system 10. Side bars 36 and 38 are deep bars 28 that also serve as the respective ends of subassembly 26 and form part of perimeter wall 30. Deep bars 28 and end bars 32 and 34 are formed of a rigid material which is most typically a metal. Each deep bar 28 has first and second opposed ends 40 and 42 which are respectively rigidly secured to inner surfaces of first and second end bars 32 and 34, typically by respective welds 44 (FIGS. 2, 3 and 9). Each deep bar 28 is in the exemplary embodiment a vertically oriented plate of metal having an uppermost or top surface or edge 46 and a lowermost or bottom surface or edge 48. Edges 46 and 48 are straight, parallel and continuous from end to end. Edges 46 and 48 define therebetween a height H1 (FIG. 7) which represents the height of deep bars 28, side bars 36 and 38 and end bars 32 and 34. Height H1 in the exemplary embodiment is about 3.5 inches and typically within the range of about 2 to 8 inches. In the exemplary embodiment, the tops and bottoms of the respective deep bars, end bars 32 and 34 and side bars 36 and 38 are respectively at the same height as one another. Deep bar 28 has flat vertical first and second opposed sides 50 and 52 defining therebetween a thickness thereof which in the exemplary embodiment is about 3/16 inch and typically is within the range of about 1/8 to 1/2 inch. Inasmuch as side bars 36 and 38 have the same configuration as the other deep bars 28, the numerical indicators 46, 48, 50 and 52 likewise represent the top, bottom and opposed sides respectively of said side bars. Each adjacent pair of deep bars 28 is axially spaced from one another so that the centers thereof define therebetween a distance D1 which is typically on the order of about four inches although this may vary depending on loading requirements. A plurality of longitudinally spaced crossbar-receiving vertical through openings or slots 54A-C is formed in each deep bar extending from first side 50 to second side 52. The slots 54A in the various deep bars are aligned along a straight horizontal axial line which is perpendicular to deep bars 28 and parallel to end bars 32 and 34 whereby the slots 54A together form a first set of slots, the aligned slots 54B together form a second set of slots, and slots 54C together form a third set of slots. Additional sets of slots like slots 54 may be formed depending on the spacing between each set and the length of deep bars used. Each slot 54 in the exemplary embodiment is in the form of a vertically elongated rectangle. Slots 54 are spaced upwardly from bottom surface 48 so that they do not communicate therewith. A plurality of longitudinally spaced through holes 56A-C is also formed in each deep bar from side 50 to side 52 such that holes 56A-C are formed directly above slots 54A-C respectively. Each of holes 56 is spaced upwardly of the respective slot 54 and downwardly of the upper or top surface 46 of the corresponding deep bar. Thus, each of slots 54 and holes 56 are spaced downwardly of top surface 46 so that none of said slots or holes communicates with the top surface 46 nor the top surface 14 of system 10 inasmuch as top surfaces 46 form a part of top surface 14. The holes 56A formed in the deep bars together form a first set of holes while holes 56B together form a second set of holes and holes 56C form a third set of holes so that the holes in each set are aligned along a straight horizontal axial line which is perpendicular to deep bars 28 and parallel to end bars 32 and 34. Each adjacent set of slots 54 measured from center to center defines therebetween a distance D2 which is the same as the distance between each adjacent set of holes 56 as measured from center to center. Each set of holes 58 is thus aligned directly above the corresponding set of slots 54.

Figure 4:
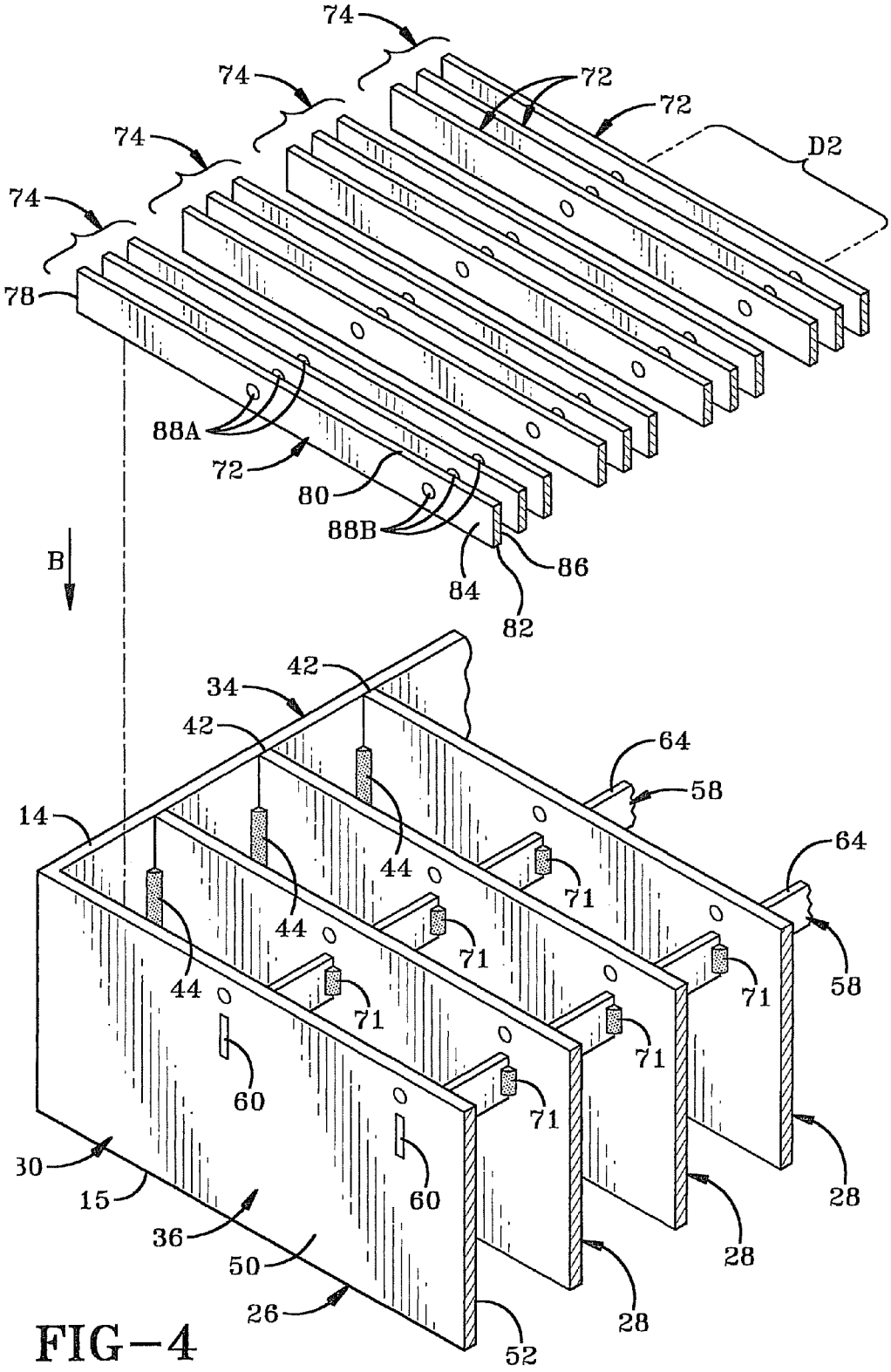
FIG. 4 is similar to FIG. 3 and shows the filler bars prior to being lowered onto the crossbars.

With primary reference to FIGS. 3 and 4, system 10 further includes a plurality of longitudinally spaced straight axial crossbars 58 having first and second opposed ends 60 and 62 (FIG. 7) defining therebetween an axial length of crossbar 58 which is substantially the same as the length defined between the outer surface of first side bar 36 and the outer surface of second side bar 38. Each cross bar 58 has an uppermost or top edge 64 and a bottom or lowermost surface or edge 66 defining therebetween a height H2 (FIG. 7) which is slightly less than the height of each slot 54. Height H2 is in the exemplary embodiment about ½ inch and typically within the range of about ½ to 1.0 inch. Edges 64 and 66 are straight, parallel and continuous from end to end. Crossbar 58 has first and second opposed vertical sides 68 and 70 defining therebetween a thickness which is slightly less than the width of each slot 54. The thickness of each crossbar 58 is in the exemplary embodiment about ⅛ inch and typically within the range of about ⅛ to 3⁄16 inch. The shape of each slot 54 and the cross sectional shape of each crossbar 58 is typically substantially the same except that the size of the cross sectional dimensions of the crossbar are slightly smaller than that of the slot. Each set of slots 54 is thus configured to slidably receive therein a respective one of crossbars 58 as it moves from an unjoined position separate from deep bars 28 horizontally and linearly in the axial direction perpendicular to deep bars 28 as illustrated by arrows A1 and A2 in FIG. 3, with Arrow A1 corresponding to one crossbar 58 already slid lengthwise into a joined position and Arrow A2 corresponding to another crossbar 58 in its unjoined position prior to insertion into slots 54A. Slots 54 and crossbars 58 are configured so that the insertion of crossbar 58 into a corresponding set of slots 54 to reach its final joined position within system 10 requires only this horizontal and linear sliding movement of the given crossbar. This is in accordance with the slots 54 having height and width dimensions which are only slightly greater than the cross sectional shape of the crossbar 58 such that each crossbar 58 upon its linear insertion is in its joined position substantially fixed relative to the deep bars 28 in the vertical direction as well as in the horizontal longitudinal direction of system 10 parallel to deep bars 28. The configuration of crossbars 58 and slots 54 also substantially prevents each crossbar from rotating about its longitudinal axis (which extends in the axial direction of system 10). Thus, each crossbar 58 is free of notches formed therein which would align with any portion of deep bars 28 which bound slots 54 whereby a crossbar 58 could be moved vertically up or down or horizontally in a longitudinal direction or rotated about its longitudinal axis in order that a portion of a deep bar was received in such a notch formed in the crossbar. Preferably, each crossbar is free of notches or other openings formed therein which extend from one side to the other.

Arrow A1 represents one of crossbars 58 having slid all the way into its final position with its first end 60 adjacent and generally flush with the outer surface of first side bar 36 and its second end 62 (FIG. 7) adjacent and typically substantially flush with the outer surface of side bar 38. Preferably, no portion of crossbar 58 extends outwardly beyond the outer surfaces of first and second side bars 36 and 38. Arrow A2 in FIG. 3 represents the movement of another crossbar 58 toward the set of slots 54A for insertion therein. FIG. 4 shows that crossbars 58 after their insertion into the respective set of slots 54 are rigidly secured to deep bars 28 by welds 71 therebetween. Typically, welds 71 are formed at a majority of the intersections between crossbars 58 and deep bars 28 and usually at all or substantially all of these intersections in order to provide a rigid structurally sound framework for mounting the other bars of system 10 thereon.

With primary reference to FIG. 4, additional structure and assembly of system 10 is described. System 10 further includes multiple axially spaced straight longitudinal filler bars 72 which in the exemplary embodiment are positioned in sets 74 of three filler bars each so that each set 74 when assembled is positioned between a respective adjacent pair of deep bars 28. Each filler bar 72 has a first end 76 (FIGS. 1, 8) and a second end 78 defining therebetween a length which is just slightly shorter than the normal distance between the respective inner surfaces of end bars 32 and 34. Each filler bar 72 has an uppermost or top surface or edge 80 and a lowermost bottom surface or edge 82 defining therebetween a height H3 (FIG. 7) which is typically the same as or less than height H2 of crossbars 58 and thus substantially less than that of deep bars 28. Height H2 of crossbars 58 in the exemplary embodiment is typically substantially less than one half that of height H1 and more typically less than one third of height H1 and generally on the order of about one quarter or less than height H1. Each filler bar 72 has first and second opposed vertical sides 84 and 86 which define therebetween a thickness of filler bar 78. In the exemplary embodiment, filler bars 72 are formed from the same stock as crossbars 58 such that height H1 and the thickness of filler bars 78 is the same as that previously noted with regard to crossbars 58. In the exemplary embodiment, filler bars 72 and deep bars 28 when assembled are evenly spaced from one another as illustrated at distance D3 in FIGS. 7 and 9. More particularly, for each adjacent pair of filler bars 72, the first side 84 which faces the second side 86 of said adjacent pair defines therebetween distance D3. Similarly, the first side 84 of each filler bar 72 which is adjacent and facing second side 52 of an adjacent deep bar 28 defines therebetween distance D3, as does the second side 86 of a filler bar which is adjacent and facing first side 50 of an adjacent deep bar 28. Distance D3 in the exemplary embodiment is about 5⁄16 inch and preferably ranges from ¼ to ½ inch. Typically, distance D7 is no more than ½ inch in order to stay within maximum guidelines of the American With Disabilities Act (ADA).

Figure 5:
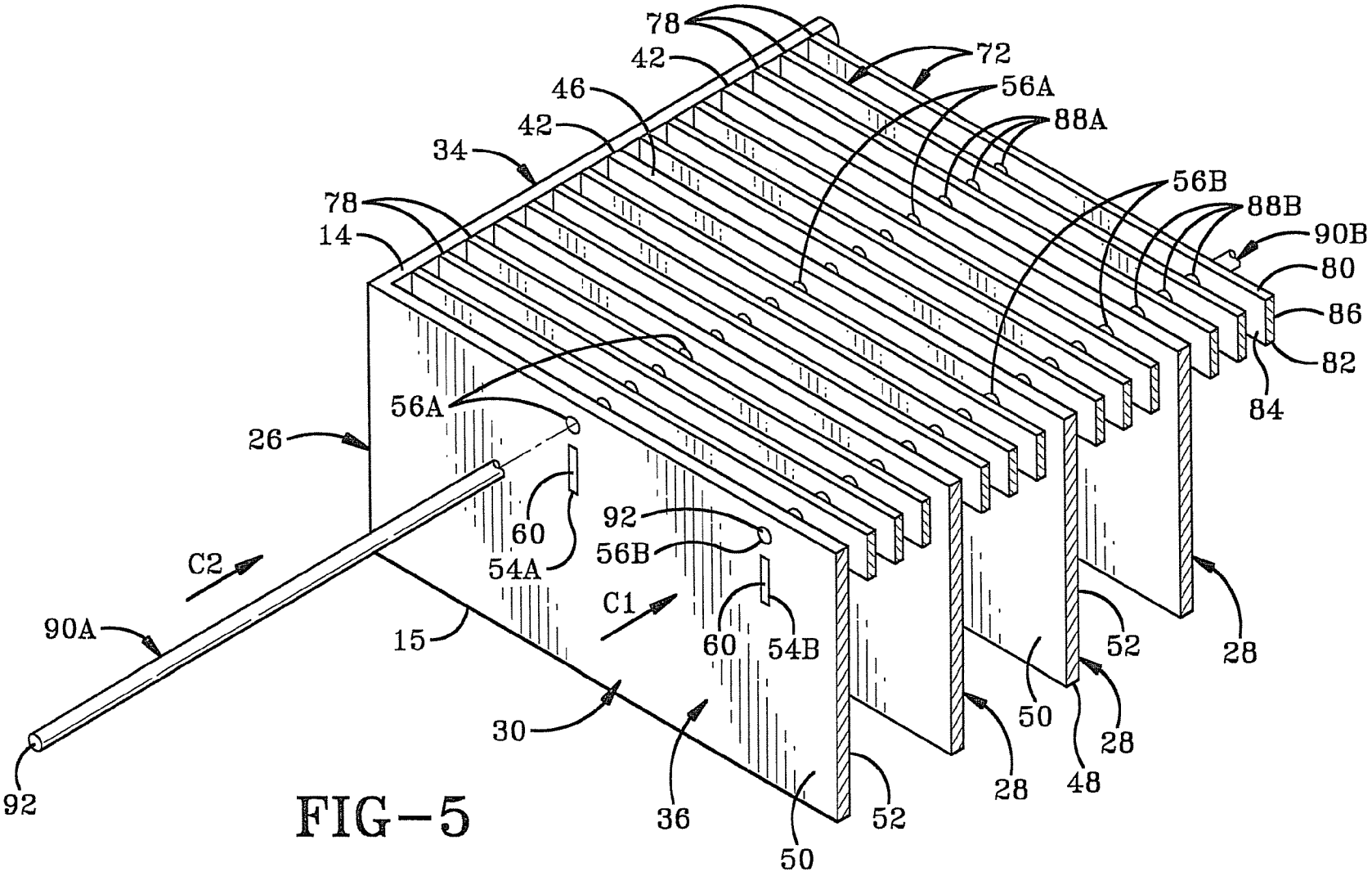
FIG. 5 is similar to FIG. 4 and shows the insertion of the joining bars through the holes in the deep bars and the filler bars.
Figure 7:
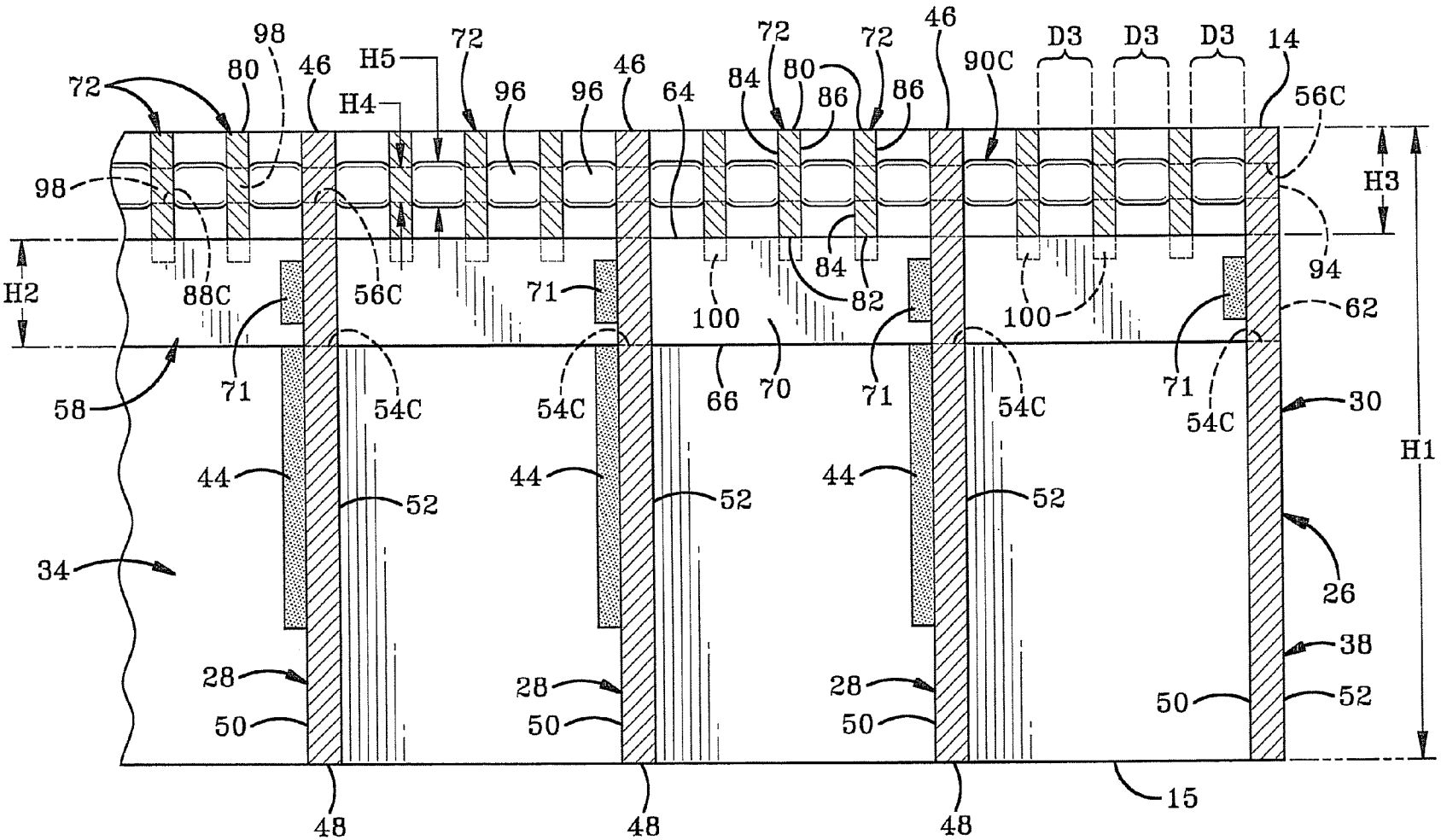
FIG. 7 is a sectional view taken on line 7-7 of FIG. 1.
Figure 8:
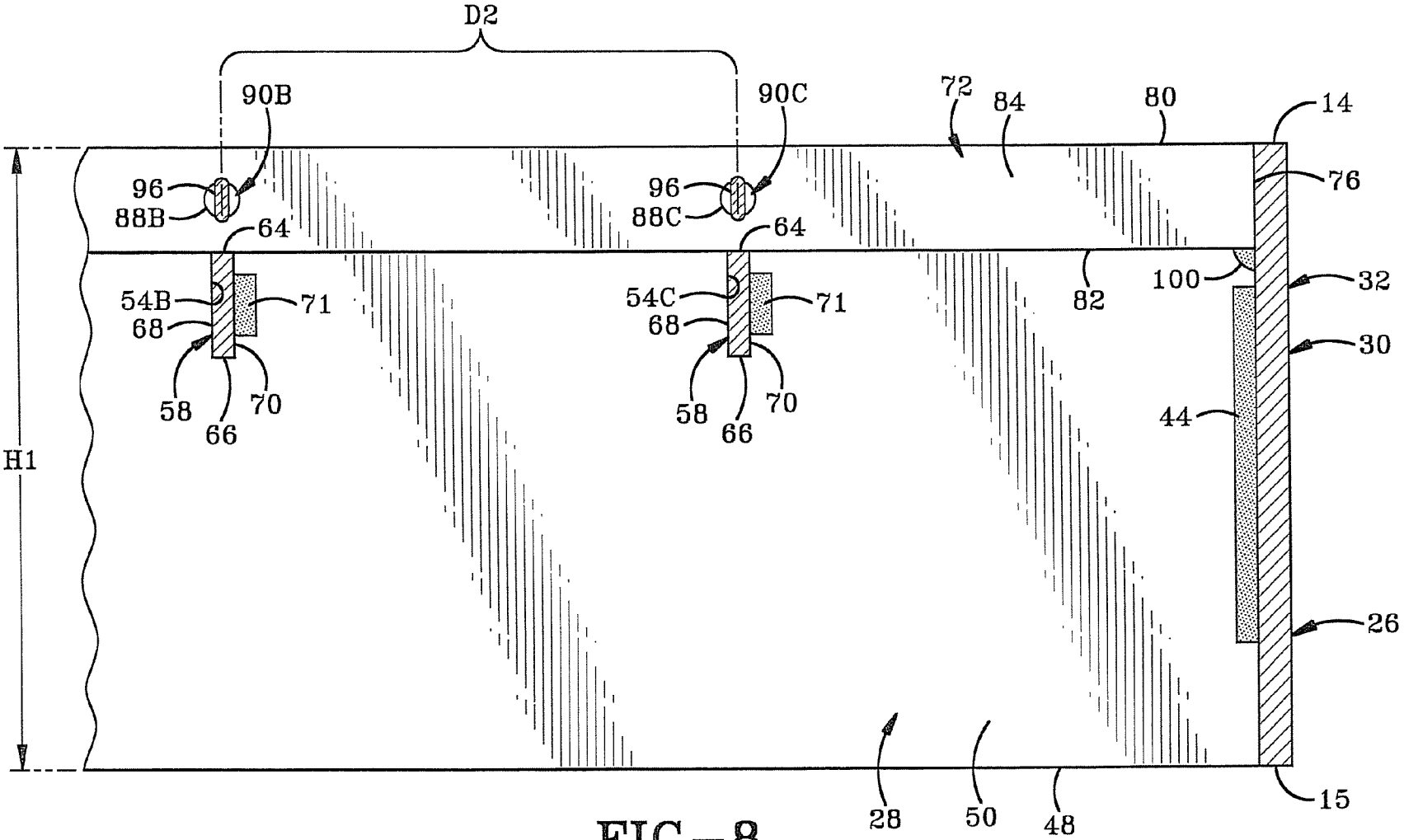
FIG. 8 is a sectional view taken on line 8-8 of FIG. 1.

FIGS. 4 and 5 illustrate that each set 74 of filler bars 72 moves downwardly (Arrow B in FIG. 4) from a position above subassembly 26 so that each set 72 is positioned as shown in FIG. 5 between an adjacent pair of deep bars 28 and so that each filler bar 72 is seated atop crossbars 58 with bottom edges 82 contacting top edges 64, as best illustrated in FIGS. 7 and 8. In keeping with the straight continuous end-to-end top and bottom surfaces of crossbars 58 and filler bars 72, crossbars 58 are free of upwardly opening notches which communicate with the top surfaces thereof for receiving a portion of filler bars 72 therein, and filler bars 72 are free of downwardly opening notches communicating with lower surfaces thereof for receiving therein respective portions of crossbars 58 when filler bars 72 are lowered into position. Longitudinally spaced circular holes 88A-C are formed in each filler bar 72, holes 88C being illustrated in FIG. 8. The holes 88A formed in the filler bars 72 together form a first set of holes while the corresponding holes 88B form a second set and the corresponding holes 88C form another corresponding set of holes. As shown in FIG. 4, set 88A and set 88B are longitudinally spaced from one another by distance D2. As illustrated in FIG. 8, set 88B and set 88C of holes also spaced from center to center by distance D2. Sets 88A, 88B and 88C are thus respectively appropriately spaced from one another so that when filler bars 72 are moved downwardly to the position shown in FIG. 5, these sets 88A-C respectively align with the sets of holes represented by holes 56A, 56B and 56C formed in deep bars 28. Holes 88 are thus spaced upwardly from slots 54 by the same distance by which holes 56 are spaced upwardly from slots 54 when filler bars 72 are seated atop crossbars 58 as shown in FIG. 5.

Figure 6:
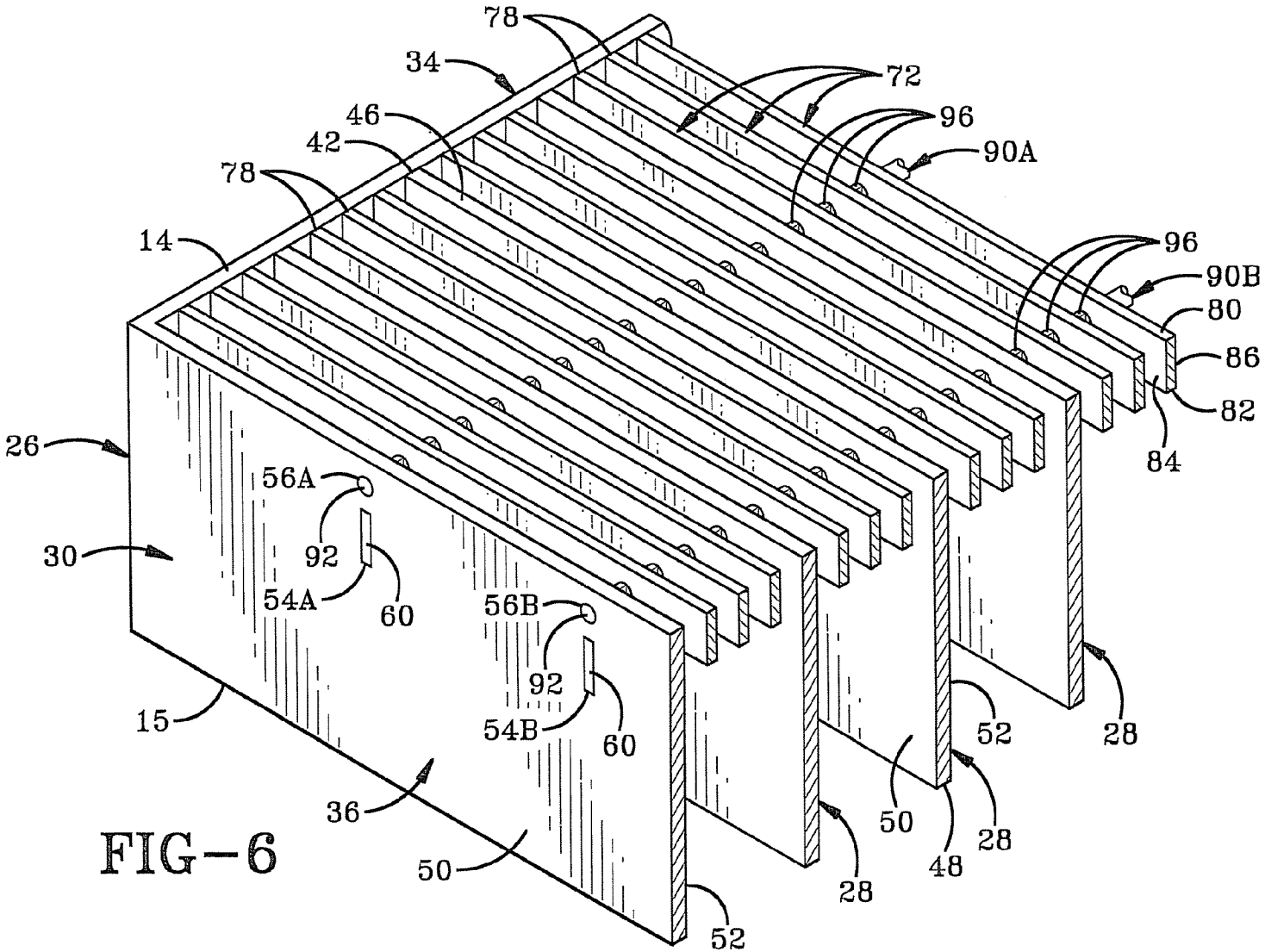
FIG. 6 is similar to FIG. 5 and shows the grating assembly after the crimping of the joining bars.

With primary reference to FIG. 5, system 10 further includes a plurality of longitudinally spaced straight axial joining bars 90A-C wherein joining bar 90C is shown in FIGS. 1 and 7-9. In the exemplary embodiment, each joining bar is a cylindrical hollow tube having first and second ends 92 and 94 (FIGS. 7, 9) defining therebetween a length which is substantially the same as that of each crossbar 58. In the exemplary embodiment, each joining bar 90 is formed of a metal tube having an outer diameter within a range of about 3/16 to 5/16 inch with a wall thickness typically ranging from about 0.028 to about 0.065 inch prior to the crimping or swaging process described further below. FIG. 5 illustrates filler bar 90B having been inserted lengthwise (Arrow C1) horizontally and linearly in the axial direction of system 10 through aligned holes 56B of each deep bar 28 and holes 88B of each filler bar 72 so that its first end 92 is adjacent and typically flush with the outer surface of side bar 36 and second end 94 (FIGS. 7, 9) is adjacent and typically substantially flush with the outer surface of side bar 38. As with crossbars 58, preferably no portion of filler bars 72 extend outwardly beyond the outer surfaces of side bars 36 and 38. FIG. 5 further shows joining bar 90A moving toward insertion (Arrow C2) into holes 56A and 88A. The horizontal axial insertion of joining bars 90 into the corresponding holes 56 and 88 thus prevents or substantially prevents vertical and longitudinal movement of filler bars 72 with respect to subassembly 26. This simple horizontal and linear insertion of a given joining bar 90 also prevents or substantially prevents the vertical and longitudinal movement of joining bar 90 and filler bars 72 relative to one another and relative to bars 28 and 58. Prior to insertion of joining bars 90, the diameter of said bars 90 is slightly smaller than the diameter of holes 56 and 88. After insertion of said joining bars 90, the portions of joining bars 90 which are disposed within the spaces between adjacent filler bars and between each filler bar and an adjacent deep bar are crimped or otherwise deformed to produce deformed segments 96 (FIG. 6) which in the exemplary embodiment have a vertical dimension which is larger than the diameter of holes 56 and 88 whereby segments 96 serve as spacers which secure filler bars 72 in the desired spaced relationship previously noted. Deformed sections 96 thus define therebetween and alternate with circular segments 98 (FIG. 9) which generally retain their original circular configuration which is slightly smaller than the corresponding holes 56 and 88 in which segments 98 are disposed. The top and bottom of each circular segment 98 thus defines therebetween a diameter or height H4 which is slightly smaller than the diameter of holes 56 and 88. Height H4 is in the exemplary embodiment substantially the same as the outer diameter of the joining bar 90 as noted above. The top and bottom of deformed segments 96 define therebetween a height H5 which is somewhat larger than height H4 and the diameter of holes 56 and 88. Each of height of H4 and height H5 is less than that of height H3 of filler bars 72. In the exemplary embodiment, height H4 is about one third that of height H3. Joining bars 90 and filler bars 72 are joined directly to one another preferably without any welds therebetween. Joining bars 90 are likewise preferably joined to deep bars 28 without any welds therebetween.

The assembly of system 10 is thus complete with the crimping of the tubular joining bars to create the deformed segments although the ends of filler bars 72 may be secured to the corresponding end bars 32 and 34 by optional welds 100 (FIG. 7). If welds 100 are used, they are typically formed between the bottom edge 82 of the respective filler bar 72 and the inner surface of the corresponding end bar 32 or 34. Thus, while system 10 is typically configured by the use of welds 44, 71 and 100, each of these welds is spaced downwardly from top surface 14 of system 10, which includes the top edges 46 of deep bars 28 and top edges 80 of filler bars 72. In the exemplary embodiment, none of the welds in system 10 forms any portion of top surface 14 or communicates therewith. Top surface 14 is primarily formed of top edges 46 and 80 of the parallel deep bars 28 and filler bars 72 although the top edges of end bars 32 and 34 also form a small portion of top edge 14 extending perpendicular to bars 28 and 72 along the outer perimeter of system 10. As illustrated in the various drawings, each of joining bars 90, crossbars 58, holes 56, holes 88 and slots 54 are in their entirety spaced downwardly from top surface 14. As illustrated in FIG. 7, the height or vertical distance between top edges 64 of crossbars 58 and top surfaces 46 of deep bars 28 is substantially the same as height H3 so that when system 10 is assembled with filler bars 72 seated atop crossbars 58, top edges 80 are substantially flush with or at the same height as top edges 46 and the remainder of top surface 14. FIG. 7 also illustrates that each joining bar 90 is spaced upwardly a short distance from the top surface 64 of crossbar 58, while FIG. 9 shows that each joining bar 90 is parallel to and disposed directly above the corresponding crossbar 58. As previously noted, the top surface 14 is free of welds in order to provide a clean aesthetic appearance to system 10. In keeping with this, deep bars 28 and the other bars which form top surface 14 are free of upwardly opening notches communicating with their respective top edges or surfaces wherein such notches are typically used to receive a crossbar or the like so that welding is commonly applied along the top surface within these upwardly opening notches. In addition, the preferred embodiment of system 10 utilizes bars such as deep bars 28, filler bars 72 and the bars forming outer perimeter 30 which have top edges or surfaces which are horizontally continuous and straight from end to end. While these top edges or surfaces may be smooth, they are often stippled or otherwise roughened to improve traction for vehicular or pedestrian traffic. The top surface 14 of system 10 is thus substantially formed of flat continuous upwardly facing top surfaces of bars which are substantially coplanar and most commonly substantially horizontal. In addition, all of the bars used in system 10 as noted above are either parallel or perpendicular to one another in the exemplary embodiment. Furthermore, none of the components of system 10 are joined to one another by rivets, threaded connection as with bolts and nuts or the like. Although riveted grating systems are very useful in a variety of settings, they are not particularly suited to provide a grating system with spacing between the bars of the top surface which is sufficiently small to prevent the spikes of high heel shoes or lower tips of walking canes from being inserted therein and becoming stuck or causing injury risks. Thus, system 10 in the exemplary embodiment does not utilize rivets or similar fasteners so that the spacing between the filler bars and deep bars as noted above does accommodate pedestrian traffic including spiked heel shoes and walking canes.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A grating system having longitudinal and axial directions comprising:

a plurality of axially spaced longitudinal deep bars each having top and bottom surfaces;

a first set of aligned through slots formed in the deep bars;

a second set of aligned through slots formed in the deep bars and longitudinally spaced from the first set of slots;

a first set of aligned deep bar through holes formed in the deep bars directly above the first set of slots;

a second set of aligned deep bar through holes formed in the deep bars directly above the second set of slots; wherein the slots and holes are spaced downwardly of the top surfaces of the deep bars so that none of the slots or holes communicates with the top surfaces of the deep bars;

a first axial crossbar slidably inserted lengthwise into the first set of slots;

a second axial crossbar slidably inserted lengthwise into the second set of slots;

a plurality of longitudinal filler bars seated on the crossbars between the deep bars and having respective top surfaces which are substantially flush with the top surfaces of the deep bars;

a first set of aligned filler bar through holes formed in the filler bars and aligned with the first set of deep bar holes;

a second set of aligned filler bar through holes formed in the filler bars and aligned with the second set of deep bar holes;

a first axial joining bar slidably inserted lengthwise into the first set of deep bar holes and first set of filler bar holes so that the first joining bar is directly above and aligned with the first crossbar;

a second axial joining bar slidably inserted lengthwise into the second set of deep bar holes and second set of filler bar holes so that the second joining bar is directly above and aligned with the second crossbar; and wherein each crossbar has joined and unjoined positions in which it is respectively separate from and joined to the deep bars; and each crossbar is slidably inserted lengthwise into the respective set of slots along a linear path to move from the unjoined position to the joined position such that the linear slidable insertion alone substantially fixes the position of the respective crossbar in the vertical and longitudinal directions relative to the deep bars.

2. The system of claim 1 wherein the crossbars have top and bottom surfaces; and the crossbars are free of bottom notches which extend upwardly from their respective bottom surfaces and receive therein respective portions of the deep bars to interlock the crossbars and deep bars to one another.

3. The system of claim 2 wherein the crossbars are free of notches that receive therein respective portions of the deep bars to interlock the crossbars and deep bars to one another.

4. The system of claim 1 wherein each of the crossbars has first and second opposed ends and a bottom surface which is straight and continuous from its first end to its second end.

5. The system of claim 4 wherein each of the crossbars has a top surface which is straight and continuous from its first end to its second end.

6. The system of claim 1 wherein each of the crossbars has first and second opposed ends and a top surface which is straight and continuous from its first end to its second end.

7. The system of claim 1 wherein the deep bars and crossbars intersect one another at respective intersections; and further comprising a plurality of welds securing the deep bars and crossbars to one another at a majority of the intersections.

8. The system of claim 7 wherein the welds are at substantially all of the intersections.

9. The system of claim 1 wherein the crossbars have respective top surfaces; and the filler bars have respective bottom surfaces which are seated on the top surfaces of the crossbars.

10. The system of claim 1 wherein the crossbars have respective top surfaces; and each crossbar is free of an upwardly opening notch which extends downwardly from its top surface and which receives therein a portion of one of the filler bars.

11. The system of claim 1 wherein the filler bars have respective bottom surfaces; and each filler bar is free of a downwardly opening notch which extends upwardly from its bottom surface and which receives therein a portion of one of the crossbars.

12. The system of claim 1 wherein the filler bars comprise three filler bars between each adjacent pair of the deep bars.

13. The system of claim 12 wherein each adjacent pair of the filler bars defines therebetween a space which has an axial dimension normal to the filler bars of no more than ½ inch.

14. The system of claim 13 wherein each deep bar and filler bar adjacent thereto defines therebetween a space which has an axial dimension normal to the filler bars of no more than ½ inch.

15. The system of claim 1 wherein each joining bar is deformed between each adjacent pair of filler bars to prevent axial movement of the joining bars and filler bars relative to one another.

16. The system of claim 1 wherein the system is free of rivets joining any of the bars to one another.

17. The system of claim 1 wherein the system has a top surface and is free of welds which form any portion of the top surface.

18. A grating system having longitudinal and axial directions comprising:

a plurality of axially spaced longitudinal deep bars each having top and bottom surfaces;

a first set of aligned through slots formed in the deep bars;

a second set of aligned through slots formed in the deep bars and longitudinally spaced from the first set of slots;

a first set of aligned deep bar through holes formed in the deep bars directly above the first set of slots;

a second set of aligned deep bar through holes formed in the deep bars directly above the second set of slots; wherein the slots and holes are spaced downwardly of the top surfaces of the deep bars so that none of the slots or holes communicates with the top surfaces of the deep bars;

a first axial crossbar slidably inserted lengthwise into the first set of slots;

a second axial crossbar slidably inserted lengthwise into the second set of slots;

a plurality of longitudinal filler bars seated on the crossbars between the deep bars and having respective top surfaces which are substantially flush with the top surfaces of the deep bars;

a first set of aligned filler bar through holes formed in the filler bars and aligned with the first set of deep bar holes;

a second set of aligned filler bar through holes formed in the filler bars and aligned with the second set of deep bar holes;

a first axial joining bar slidably inserted lengthwise into the first set of deep bar holes and first set of filler bar holes so that the first joining bar is directly above and aligned with the first crossbar;

a second axial joining bar slidably inserted lengthwise into the second set of deep bar holes and second set of filler bar holes so that the second joining bar is directly above and aligned with the second crossbar; and wherein the crossbars have top and bottom surfaces; and the crossbars are free of bottom notches which extend upwardly from their respective bottom surfaces and receive therein respective portions of the deep bars to interlock the crossbars and deep bars to one another.

19. A grating system having longitudinal and axial directions comprising:

a plurality of axially spaced longitudinal deep bars each having top and bottom surfaces;

a first set of aligned through slots formed in the deep bars;

a second set of aligned through slots formed in the deep bars and longitudinally spaced from the first set of slots;

a first set of aligned deep bar through holes formed in the deep bars directly above the first set of slots;

a second set of aligned deep bar through holes formed in the deep bars directly above the second set of slots; wherein the slots and holes are spaced downwardly of the top surfaces of the deep bars so that none of the slots or holes communicates with the top surfaces of the deep bars;

a first axial crossbar slidably inserted lengthwise into the first set of slots;

a second axial crossbar slidably inserted lengthwise into the second set of slots;

a plurality of longitudinal filler bars seated on the crossbars between the deep bars and having respective top surfaces which are substantially flush with the top surfaces of the deep bars;

a first set of aligned filler bar through holes formed in the filler bars and aligned with the first set of deep bar holes;

a second set of aligned filler bar through holes formed in the filler bars and aligned with the second set of deep bar holes;

a first axial joining bar slidably inserted lengthwise into the first set of deep bar holes and first set of filler bar holes so that the first joining bar is directly above and aligned with the first crossbar;

a second axial joining bar slidably inserted lengthwise into the second set of deep bar holes and second set of filler bar holes so that the second joining bar is directly above and aligned with the second crossbar;

wherein the deep bars and crossbars intersect one another at respective intersections; and a plurality of welds securing the deep bars and crossbars to one another at a majority of the intersections.

20. The system of claim 18 wherein the system has a top surface and is free of welds which form any portion of the top surface.

21. The system of claim 19 wherein the system has a top surface and is free of welds which form any portion of the top surface.

* * * * *